United States Patent [19]

Parekh et al.

[11] Patent Number: 4,478,610

[45] Date of Patent: Oct. 23, 1984

[54] METHOD OF PREPARING FLEXIBLE BACKING MATERIAL FOR USE IN COATED ABRASIVES

[75] Inventors: Dhan N. Parekh, Williamsville; Paul R. Schweyen, Tonawanda, both of N.Y.

[73] Assignee: Carborundum Abrasives Company, Niagara Falls, N.Y.

[21] Appl. No.: 577,046

[22] Filed: Feb. 6, 1984

Related U.S. Application Data

[62] Division of Ser. No. 412,149, Aug. 27, 1982, Pat. No. 4,437,865.

[51] Int. Cl.[3] ..... C09K 3/14

[52] U.S. Cl. ..... 51/298; 427/389.9; 427/412; 428/102; 428/105; 428/109; 428/143; 428/283; 428/323

[58] Field of Search ..... 51/298; 427/389.9, 412; 428/102, 105, 109, 143, 283, 323

[56] References Cited

U.S. PATENT DOCUMENTS

| | | | |
|---|---|---|---|
| 2,130,944 | 9/1938 | Bowen | 474/268 |
| 2,288,649 | 7/1942 | Robie | 51/297 |
| 2,890,579 | 6/1960 | Mauersberger | 66/192 |
| 3,030,743 | 4/1962 | Raymond | 51/207 |
| 3,732,652 | 5/1973 | Farhal et al. | 51/401 |
| 3,972,161 | 8/1976 | Zorss | 51/206 R |
| 3,991,593 | 11/1976 | Bermert et al. | 66/85 A |
| 4,215,516 | 8/1980 | Haschle et al. | 51/399 |
| 4,396,657 | 8/1983 | Ibrahin | 428/283 |

FOREIGN PATENT DOCUMENTS

| | | |
|---|---|---|
| 722882 | 12/1965 | Canada . |
| 45408 | 2/1982 | European Pat. Off. . |
| 1410153 | 10/1965 | United Kingdom . |
| 1016484 | 1/1966 | United Kingdom . |

OTHER PUBLICATIONS

"The Latest Offspring of the Malims Family", Textima Information, Unitechno Aussenhandelsgesellschaft M.B.H. 7/13/78.

*Primary Examiner*—James J. Bell
*Attorney, Agent, or Firm*—Michael L. Dunn

[57] ABSTRACT

A flexible sheet material particularly suitable as a backing for coated abrasive products and method of making same are described. The flexible sheet material is of that type employing a straight warp fabric. The yarns of the straight warp fabric are coated and at least partially impregnated with a flexible polymeric material, such as polyvinyl alcohol, having thereover an intermediate filling coat of a phenol formaldehyde resin/latex and an outer filling coat of phenol formaldehyde resin. Alternatively, the straight warp fabric includes a penetrating base coating of flexible polymeric material and thereover a backfilling including approximately equal parts by weight of calcium carbonate and magnesium carbonate dispersed in a flexible synthetic polymeric resin which backfilling fills the interstices and encapsulates the yarns of one of the yarn arrays that form the straight warp fabric. The straight warp fabric may include a non-woven web located between adjacent arrays of warp and weft yarns. The flexible sheet material described herein may be thereafter coated in conventional manner with abrasive grains to form a coated abrasive sheet material that is particularly suitable for use in the formation of endless abrasive belts.

14 Claims, No Drawings

METHOD OF PREPARING FLEXIBLE BACKING MATERIAL FOR USE IN COATED ABRASIVES

This is a division of application Ser. No. 412,149 filed Aug. 27, 1982, now U.S. Pat. No. 4,437,865.

The present invention relates to a flexible sheet material including a straight warp fabric whose yarns are encapsulated in a flexible polymeric material and subsequently further processed. Such flexible sheet material is particularly suitable for incorporation in coated abrasive products, particularly endless abrasive belting.

BACKGROUND OF THE INVENTION

Although woven fabrics have been successfully employed as backings for flexible coated abrasive products, such backings have not provided adequate performance in certain severe grinding operations. In these applications which require high strength of the load bearing member of the belt and retention of such high level of strength throughout the useful life of the abrasive coating thereon, the use of woven fabric backings has resulted at times in sudden dramatic and uncontrolled failure of belts, particularly when wide belts, that is over 24" in width, are employed in certain severe grinding operations. Another undesirable characteristic that often accompanies the use of woven fabrics as a backing in abrasive belting is puckering, which is believed to be caused by localized stretching of the belts when employed in severe grinding applications such as abrasive planing and machining. These undesirable characteristics appear to be inherent in woven fabric backed coated abrasive products including those in which the woven fabric is formed of polyester yarns.

These undesirable properties which appear to be inherent in woven fabric backed coated abrasive products can be mitigated by replacing the woven fabric with a straight warp fabric. For purposes of the present invention, a "straight warp fabric" is one that includes an array of warp yarns or cords that extend generally parallel to one another in a first plane joined to an array of weft yarns that extend generally parallel to one another in a second plane that is adjacent and parallel to the first plane. The weft yarns extend generally transversely of the warp yarns. The weft and warp yarns are joined to one another. This may be accomplished by a stitching yarn network. Alternatively, the warp and weft yarns may be joined to one another by adhesive bonding. The warp yarn array and the weft yarn array separately constitute individual planes that are parallel to one another. There is no interlacing of the warp and weft yarns with one another. The warp yarns all lay on one surface of the fabric and have no crimp in them, that is they lie in one plane. In similar manner, the weft yarns lie in one plane and have no crimp in them. Straight warp fabrics retain a significantly higher portion of theoretical strength of the yarns relative to a woven fabric formed on the same yarns and having the same count, that is the same number of yarns per unit dimension taken in the plane of the fabric and transversely to the lengthwise direction of the yarns or cords.

For purposes of the present invention, the term "yarn" is a generic term for a continuous strand of textile fibers, filaments or material in the form suitable for knitting, weaving or otherwise combining to form a textile fabric. The term "plied yarn" refers to the twisting together of two or more single yarns or plied yarns to form, respectively, plied yarn or cord. The term "cord" refers to the product formed by twisting together two or more plied yarns.

The terms "warp" and "weft" when used with respect to straight warp fabrics are not to be confused with their usage in conventional woven fabrics. For purposes of the present invention, the warp yarns or cords are those that extend in the machine direction during manufacture of the straight warp fabric, that is in the lengthwise direction of the fabric. This orientation is generally preserved when the fabric is employed as a backing for a coated abrasive product, such as belting; however, this need not be the case. The weft yarns generally extend across the warp yarns and form an angle of at least 45° relative to the direction of the warp yarns.

While the invention will be described with respect to a straight warp fabric including a single array of warp yarns and a single array of weft yarns, it is to be understood that the use of a fabric including additional arrays of yarns, whether woven or not, is within contemplation of the invention. For purposes of the present invention, the term "straight warp fabric" also includes one that has inserted between arrays of straight yarns or attached to at least one array of straight yarns, a web of non-woven fabric. Such webs are produced by well known techniques and include spun-bonded and stitch-bonded fabrics. The use of a non-woven web insert in a straight warp fabric increases the available surface area for coating resins and latexes thereby improving adhesion of the components of the backing to one another and to subsequently applied coatings including the abrasive grain material. The incorporation of a non-woven web assists in controlling placement of the cloth finishing mixes. The presence of such non-woven web additionally increases the resistance to tearing of the flexible sheet material as well as providing additional cover.

Straight warp fabrics tend to be or may be of a more open construction than conventional woven cloth of the same design strength. This greater openness requires employment of different coating materials and techniques to fill in the interstices that exist between the adjacent yarns of each array in such straight warp fabrics in their greige state. The term "greige" as applied to fabrics for purposes of the present invention refers to the fabric in the state it exists as received from the machine on which it was formed. In the case of a straight warp fabric, a greige fabric is one delivered to or taken from the wind-up stand of the straight warp fabric forming machine. The present invention is particularly directed to such techniques and materials to provide a flexible sheet material that is highly stable and durable when used as a backing for coated abrasive products when compared to conventional woven cloth backings formed from yarns or cords of identical construction and count.

DETAILED DESCRIPTION OF THE INVENTION

According to the present invention there is provided a flexible sheet material suitable as a backing material for coated abrasive products. The sheet material is formed from a straight warp fabric that includes an array of warp yarns that extend generally parallel to one another in a first plane, an array of weft yarns that extend generally parallel to one another in a second plane that is adjacent and parallel to said first plane. The weft yarns extend generally transversely of the warp yarns although not necessarily perpendicularly to the direction of the warp yarns. The straight warp fabric also includes a means for joining the array of warp yarns and the array of weft yarns to one another. A preferred straight warp fabric is one produced on a Malimo TM machine in which the array of warp yarns and the array of weft yarns are joined to one another by a stitching yarn network. The yarns of the straight warp fabric are coated and at least partially impregnated with a sizing of flexible polymeric material.

A particularly preferred polymeric material is a polyvinyl alcohol (PVA). A representative suitable polyvinyl alcohol is Elvanol TM T-66 polyvinyl alcohol obtainable from E. I. DuPont deNemours & Company, Wilmington, Del. This material is fully hydrolized (99.0% minimum PVA). T-66 is preferred for two reasons. First, T-66 readily forms a slurry in cold water without lumping and readily dissolves on heating to 180° F. Second, Elvanol TM T-66 polyvinyl alcohol is diluted to a 10% by weight solution in water such solution has a relatively low viscosity facilitating desired penetration of the solution into the yarn bundles and low wet pick up of the solution. From about 4 to about 12 percent dry weight basis of dipsize is preferably imparted (added-on) to the greige fabric. A preferred manner of applying the dipsize is by dipping or immersing the fabric into a vat containing the flexible polymeric material in diluted form. Preferably a sufficient amount and distribution of dipsize exists to reduce the air permeability of the fabric from about 10 to about 40 percent when compared to the fabric in its greige state.

The PVA dipsize serves four purposes. First, it imparts to the straight warp fabric a high degree of stability or resistance to distortion and, thus, facilitates further processing of the straight warp fabric. Second, it facilitates trimming of a predetermined amount from each longitudinally extending edge of the fabric after heat setting. When the PVA dipsize is employed, trimming can be accomplished readily without causing trailing filaments or yarns. In other words, the trimmed edges are cleanly cut. Third, PVA exhibits good adhesion to polyester fiber and to the subsequently applied mixes. Fourth, the PVA penetrates at least a limited amount into each yarn bundle and encapsulates at least the outermost layers of fibers of each yarn bundle and thereby protects the individual filaments from embrittlement which otherwise results when the phenolic face fill mix directly wets the fibers and yarns.

Following application of the sizing of flexible polymeric material, the straight warp fabric is dried to remove the water that was picked up by the fabric upon wetting of all exposed surfaces of the fabric with an aqueous solution of the polyvinyl alcohol. Drying may be suitably accomplished by carrying it on a clip tenter through an oven set at 250° F. During drying sufficient lengthwise tension is applied to keep the fabric taut with no sagging when it was released from the clips. Crosswise tension is applied during drying to maintain the fabric at or near its greige width.

Following drying of the fabric that has been sized with a flexible polymeric material (dipsized fabric), the fabric is heat set on a clip tenter frame to further develop tensile strength, particularly in the warp yarns of the straight warp fabric, and to increase dimensional stability of the fabric to provide greater resistance of the fabric to stretching when tensile loads are applied, for example, in abrasive belt grinding applications. Heat setting may be accomplished by stretching the fabric a predetermined amount in the direction of the warp yarns while at about room temperature, for example, as the fabric enters the oven or range and thereafter maintaining tension on the fabric to prevent shrinkage thereof in its lengthwise direction while in the heating zone. Upon exiting the heating zone, the lengthwise amd widthwise tension on the fabric is reduced and the fabric quenched with forced ambient air prior to take-up. Industrial experience indicates that for heavy duty industrial abrasive belt applications, the straight warp fabric should exhibit less than 6.0 percent stretch when the load applied per inch of fabric width in the warp direction of the fabric does not exceed 170 pounds. When the warp yarns of the straight warp fabric are of nylon or polyester, the heat setting process should be adjusted to yield a fabric that exhibits less than 6.0 percent stretch when the load applied per inch of fabric width in the warp direction of the fabric is 170 pounds. When the warp yarns of the straight warp fabric are of aramid or fiberglass it is expected that no heat setting will be required to impart requisite stability to these fabrics since aramid and fiberglass yarns are of sufficiently high tensile modulus and stability as received from the yarn manufacturer. The precise heat treatment conditions are determined empirically for a given fabric construction.

The processing of the fabric is preferably varied after heat treatment when required according to whether or not the fabric includes a non-woven web.

When the fabric includes a non-woven web, following heat treatment an intermediate filling coat is applied to the fabric. The intermediate filling coat is a phenol formaldehyde resin/latex in aqueous dispersion that preferably includes a colorant dispersion. Two or more applications of this intermediate filling coat may be required in order to achieve sufficient filling of the spaces between adjacent yarns of the fabric. The intermediate filling coat may be applied by immersion of the fabric into a vat of filling coat. The fabric is dried after each pass through the vat of intermediate filling coat material.

When the fabric includes a non-woven web, following application of the intermediate filling coat there is applied an outer filling coat of phenol formaldehyde resin/inorganic filler, such as a diatomite or $CaCO_3$ or Camel-Carb TM Natural Ground limestone filler. The outer filling coat is then partially (B-staged) cured, for example, by passing the fabric through oven having a temperature of 300° to 345° F., for a time of 1 to 2 minutes.

Following partial curing of the outer filling coat, the flexible sheet material is in a form ready for the application of abrasive grains. Abrasive grains are adhesively bonded to the flexible sheet material according to conventional techniques of applying maker adhesive which is usually a phenolic resin, grain and size coat and curing the maker and size coats at a temperature above room temperature. The techniques and chemicals that are employed to secure the abrasive grains to the backing material are well known to coated abrasive manufacturers and are, therefore, not discussed further herein.

The finishing technique just hereinbefore described is particularly suitable for use with a straight warp fabric of the type that includes a non-woven web incorporated as an integral part of the straight warp fabric at the time of its formation. When such non-woven web is not present, the fabric finishing technique is preferably modified following heat setting of the fabric. The interstices between the yarns of the warp array of the base coated fabric are filled with a backfilling that includes approximately equal parts by weight of calcium carbonate and magnesium carbonate pigments dispersed in a flexible synthetic polymer resin. A preferred synthetic polymer resin is polyvinyl alcohol (PVA). The backfill may be applied via knife-coating. The rheology of the backfill is such that when applied to the warp array of a horizontally extending fabric whose warp array is uppermost, the backfill penetrates to but does not encapsulate or fill the interstices between the adjacent yarns of the weft array. Following application of the backfill and drying of the backfill at a temperature above ambient, a backsizing is applied over the backfilling, that is, to the warp cord array of the backfilled fabric. The backsizing includes a synthetic heat reactive polymer latex and finely ground or finely divided calcium carbonate filler dispersed in water. An acrylic latex is preferred. Following application of the backsizing and drying thereof, a face filling is applied to the weft yarn side of the fabric. The face filling preferably includes a phenolic resin and finely ground calcium carbonate filler. Following partial curing of the face filling, the flexible sheet material is ready for the conventional steps of applying maker adhesive grain and size coat to the weft cord side of the fabric.

It is preferred that after heat setting of the fabric according to either one of the just described processes that a predetermined amount of fabric be removed from each longitudinally extending edge of the fabric to eliminate any fabric which may not have received heat setting treatment equal to that of the remainder of the fabric. Such unequal treatment is believed to be caused by the presence of the clips of the tenter frame that engage the selvages of the fabric as it passes through the heat setting oven.

The following examples serve to illustrate preferred embodiments of the invention.

EXAMPLE I

A straight warp fabric was made on a Malimo TM machine. The fabric has a warp count of 18 ends per inch. The warp yarns are 840 denier Dacron TM type 68B high tenacity filament obtained from E. I. DuPont deNemours, Wilmington, Del. (DuPont). The weft yarns are filament textured 400 denier polyester type P-3187 intermingled, available from MacField Texturing Company, Madison, N.C. (MacField). The weft count is approximately 48 picks per inch. The Malimo TM machine spec is set at 48 picks per inch but the resulting fabric varies somewhat from this. The stitching yarn network that binds the warp yarn array to the fill yarn array is formed from 150 denier type 56 semi-dull filament polyester, available from DuPont. The stitch length is 1.0 millimeter. A non-woven web is inserted between the warp yarn array and the weft yarn array. The non-woven insert is DuPont Reemay TM type 2111. Reemay TM type 2111 is a spun-bonded straightfiber staple polyester weighing 0.70 to 0.75 ounces per square yard. The greige fabric just described weighs 17.6 pounds per sandpaper maker's ream (lbs./R). A sandpaper maker's ream is 480 9"×11" sheets and contains a total of 330 square feet. The air permeability of the greige fabric when tested according to ASTM procedure D737-75 (Frazier) is 110 cubic feet per minute per square foot at a pressure drop of one half inch water. The greige fabric exhibits 8.0 percent elongation at 170 pounds per inch width applied load in the direction of the warp cords. The greige fabric exhibits an elongation of 3.8 percent at 40 pounds per inch width load applied in the direction of the weft cords. The greige fabric ruptures at 315 pounds per inch width load applied in the direction of the warp yarn array and at 135 pounds per inch width load applied in the direction of the fill yarn array, respectively.

The rupture loads and elongation or stretch characteristics of the fabric are measured on an Instron tester. The test specimens are one inch wide and, for the fabric of this Example No. I, include 20 warp cords or approximately 48 weft cords. Instron grips G-61-3D are employed. The grip faces are G-61-1D-8, have rubber contact surfaces, measure 3"×2" and are air operated at a sufficiently high pressure, for example 2000 psig, to preclude slipping of the specimen under testing conditions. The initial jaw separation is 5 inches. The rate of separation of the jaws is one half inch per minute. Full scale load is 500 pounds. Breaking strength may be read directly from the chart. Elongation or stretch is calculated from the chart knowing the initial gauge length of 5 inches, the chart speed and speed of grip separation.

The greige fabric, including the non-woven web insert, is saturated with an aqueous solution of PVA. The concentration of the PVA solution is 10 percent by weight and has a viscosity of 30 to 40 centipoise at 170°-190° F. Commercially available PVA is prepared from polyvinyl acetates by the controlled replacement of the acetate groups with hydroxyl groups. Commercial PVA grades differ in the content of residual acetate groups and, therefore, differ in viscosity characteristics. Commercial grades of PVA also differ in molecular weight and, accordingly, differ in strength elongation and flexibility of the dried PVA film. As previously stated, Elvanol TM T-66 is preferred. A solution of 10 percent by weight of Elvanol TM T-66 PVA has a relatively low viscosity that facilitates obtaining the desired penetration of the PVA solution into the yarn bundles and in low wet pickup. The greige fabric is immersed in a tank or vat containing the PVA soluiton. The temperature of the solution is controlled and maintained constant at 180°-190° F. by provision of a water jacket about the tank. Excess PVA solution is removed from the wetted cloth by passing the wetted cloth through a set of squeeze rolls, one of which is rubber, the other steel, to yield a typical wet pickup of 13.6 pounds per ream, calculated on a measured dry pickup of 1.36 pounds per ream. A dry pickup of 1.36 pounds per ream corresponds to about 7 percent add on of PVA. The rubber covered roll is 18 inches in diameter and has a Shore A durometer of 80-85. The steel roll is located below the rubber-covered roll and is also of 18 inches diameter. The steel roll is pneumatically loaded against the rubber roll to adjust the squeezing action.

After passage of the fabric through the PVA solution and the squeeze rolls, the fabric is carried on a clip tenter through a two-zone steam heated oven set at 250° F. in each zone to remove the water. The fabric is exposed in the oven for about 1 minute. While being dried, tension is applied to the fabric in its lengthwise direction in an amount sufficient to keep the fabric taut with no sagging upon release from the clips. The tenter frame applies tension in the crosswise direction of the straight warp fabric to yield a dry width of 64 inches at the output end when the starting width of the wet fabric is 64 to 65 inches.

Typical properties of the dried PVA treated fabric are 19.0 pounds per ream, an air permeability of 65 cfm/square foot (ASTM D737-75), 20 ends per inch warp count, 7.4 percent warp elongation at 170 pounds applied load, 4.0 percent weft stretch at 40 pounds applied load and breaking strengths of 334 pounds per inch and 150 pounds per inch for the warp and weft yarn directions, respectively.

The pre-dried PVA treated fabric is heat set on a clip tenter frame for about 2.2 minutes in a gas-fired range set at 445° F. and having forced circulation of the hot, dry air including combusted fuel gases to provide uniform heat transfer. A lengthwise tension of 15 to 20 pounds per inch of width of fabric is uniformly applied across the width of the fabric and is maintained on the fabric while in the heating zone. The fabric is stretched as it enters the heating zone while at about ambient, i.e. room, temperature. The fabric is stretched 1.4 percent based on PVA dipsized and dried length. While in the heating zone, tension is maintained on the fabric to prevent lengthwise shrinkage thereof. After exiting the heating zone, tension on the fabric is reduced and the fabric cooled with forced ambient air and taken up. Typical properties of the heat set fabric are a weight of 22.2 pounds per ream, an air permeability of 40 cfm/square foot, 22 warp ends per inch, 5.8 percent warp stretch at 170 pounds per inch applied load, 7.6 percent weft direction elongation at 40 pounds per inch applied load in the weft direction and breaking strengths of 374 pounds per inch and 132 pounds per inch for the warp and weft directions, respectively. The width of the fabric after heat setting is 57½ to 58 inches. The net length of the fabric has been increased by the heat setting process while the net width of the fabric has been reduced. The warp yarns are noticeably smaller in diameter than in the greige fabric and the fabric is now of a uniform straw color on both sides.

Following heat setting of the fabric, a predetermined amount is trimmed from each longitudinally extending edge. The heat set fabric width of 57½–58 inches is reduced to 56 inches. Trimming is done to remove that part of the fabric that was held by and adjacent to tenter clips during the heat setting process. These portions of the fabric are not exposed to the same environment that the remainder of the fabric is exposed and, therefore, are not heat set identically. Removal of these longitudinally extending edge portions reduces or prevents edge curling of abrasive belts made from the fabric.

Following the trimming operation, the cloth is dip filled by immersing it into a phenolic resin/latex mix, removing the excess mix by running the wet fabric through a set of rubber covered squeeze rolls that are 12½ inches in diameter and have a Shore A durometer of 80–85 and thereafter passing the fabric through an oven to dry it. The oven employed in this example included two zones. The first zone was set at 300° F. and the second at 340° F. The time in each zone was about ¾ minute. This mix has a total solids content of 20 percent by weight, a nominal viscosity of 10 centipoise at 105° F., the temperature at which the mix is applied, and a resin solids to latex solids ratio of about 1. Formulation is as follows in Table I:

TABLE I

| Vendor | Ingredient | Weight % Wet | Parts by Weight Dry |
|---|---|---|---|
| Clark Chemical Co. | Resin CR-3597 (72%) | 12.16 | 8.76 |
| B. F. Goodrich Chemical Co. | Hycar TM 1571 latex (44%) | 20.03 | 8.81 |
| American Cyanamid Co. | Aerosol OT (75%) | 0.18 | 0.14 |
| Nalco Chemical Co. | Nalco TM 2311 Antifoam (100%) | 0.06 | 0.06 |
| Harshaw Chemical Co. | W-3247 Burnt Umber Pigment Dispersion (49%) | 3.67 | 1.80 |
| Borden Chemical Co. | Casco Joint L Glue (25%) | 1.38 | .34 |
| | Water | 62.52 | 0.00 |

The phenolic resin is a water emulsifiable phenol-formaldehyde. Hycar TM 1571 is an acrylonitrile-butadiene latex. Aerosol OT is a wetting agent. W-3247 is a coloring agent. Joint L Glue is an ammoniated casein and serves as a stabilizer. This mix is of low viscosity to insure wetting of all exposed surfaces of the PVA treated filaments and yarns. This mix also provides some filling of the spaces or interstices between adjacent yarns. The dry add-on from one pass of this mix is 0.75–1.25 pounds per ream.

A second pass, utilizing the same method of application and mix, provides a further dry add-on of 1.00–1.50 pounds per ream of the mix indicated in Table I. The second pass further fills the cloth.

The fabric is then passed a third time through the same or similar apparatus, however, this time a different mix is used. For the third pass, a phenolic resin/filler mix is employed that has a total solids content of 70–75 percent and a viscosity of about 1800 centipoise at 90° F., which is the application temperature. The third pass causes a dry add-on of 5–8 pounds per ream. The formulation of the resin filler mix is given in Table II.

TABLE II

| Vendor | Ingredient | Weight % Wet | Parts by Weight Dry |
|---|---|---|---|
| HPP Division Carborundum Co. | R6 Phenolic Resin (73%) | 84.57 | 61.74 |
| Johns-Manville Products Corp. | Celite TM HSC | 8.46 | 8.46 |
| Dow Chemical Co. | Dowanol TM EE | ca6.55 | 0.00 |
| ICI Americas | Span TM 20 (100%) | 0.42 | 0.42 |

R6 Resin is a phenol-formaldehyde resin having a ph of 7.7, a specific gravity of 1.12 and a viscosity of about 1400 centipoise, and a gel time of 21 minutes at 121° C. Gel time is measured on a ten gram sample using a gel time meter (Catalogue No. 22 from Sunshine scientific Instrument Co., Philadelphia, PA). This apparatus has a rotatable spindle that is immersed in the sample. The time to stalling of the initially rotating spindel is recorded. This resin is stored under refrigeration to reduce self reaction. Celite TM HSC is a diatomite filler employed to increase the viscosity of the mix. Dowanol TM EE is ethylene glycol monoethyl ether and is employed as required to adjust the viscosity of the mix to 1800 centipoise at 90° F., the application temperature of the mix. Dowanol TM EE is added to offset the increase in viscosity of the mix that occurs with passage of time due to polymerization of the R6 resin with time. Viscosity is controlled to provide reproducibility in penetration coverage and flow properties of the mix. Span TM 20 is a wetting agent and is used to facilitate wetting of the substrate by the mix. As with the first two passes during which finish is applied, the amount of wet mix remaining on the fabric can be adjusted by varying the amount of pressure applied to the fabric by the squeeze rolls.

Typical properties of the fabric following application of the R6 phenol formaldehyde resin mix and subsequent drying of the mix are a warp breaking strength of 318 pounds per inch, a warp elongation of 5.8 percent at 170 pounds per inch applied load, and an Elmendorf tear strength of 4500 g, measured on the weft yarns. No value on Elmendorf tear was obtained for the warp yarns since the fabric strength exceeded the capacity of the available testing apparatus. Elmendorf tear corresponds to ASTM procedure D1424-63.

Following application of the R6 resin and partial curing (B-staging) thereof, the straight warp fabric is in the form of a flexible sheet material suitable as a backing for a coated abrasive product. Conversion of the flexible sheet material into a coated abrasive product is done utilizing conventional techniques of applying maker adhesive followed by the application of grain and size coatings. The finished cloth, after coating with 50 grit aluminum oxide, curing and flexing, typically exhibits a breaking strength of 360 or more pounds per inch width measured in the warp direction and elongation of less than 6.0 percent at an applied load of 170 pounds per inch in the warp direction, an ASTM D2261-32 tongue tear of 19.4 pounds and peel adhesion of 25.5 pounds per inch width.

Peel adhesion testing is used to determine how securely the abrasive grain is bonded to the flexible sheet material. The peel adhesion test specimens are prepared by bonding 1"×11" coated abrasive samples to a piece of steel that is ¼" thick×1" wide×6" long. The steel bar is cleaned and sandblasted prior to bonding. The sample of coated abrasive cloth is cut with the long dimension parallel to the warp direction of the cloth. Epoxy resin (equal parts of DER 331, available from Dow Chemical Co. and Versamid TM 125, available from Henkel Corp.) is used to bond the grain side of the sample to the steel bar with the excess length of the coated abrasive sample projecting beyond one end of the bar and forming a tab. The test specimens are then oven cured for 16 hours at 220° F. and conditioned at 70° F., 50% relative humidity for at least one hour prior to testing on an Instron tester. The tab of the sample is partially stripped away from the steel bar. This end of the bar is placed in one jaw of the Instron tester and the tab of the sample is placed in the other jaw. Chart speed and jaw separation speed are both ½ inch per minute. Full scale load is 50 pounds and gauge length is 5 inches. Approximately two inches of the specimen are pulled apart. There are several ways to read the test result from the Instron chart paper. A preferred method is to measure each peak and take an average of the peaks and report this value.

As previously stated, when the straight warp fabric is of the type that does not include a non-woven insert web, the finishing mixes and technique must be adjusted to account for the greater openness of the fabric when compared to a straight warp fabric having a non-woven insert or a conventional woven fabric such as a twill weave. The following Example II describes such a process and the necessary mixes for use in such a process.

EXAMPLE II

The fabric of this example was made on a Malimo TM machine. The warp count is 18 ends per inch of fabric width of 840 denier type 68B Dacron TM polyester from DuPont. The weft yarns are textured 150 denier polyester filament from MacField and are arrayed at approximately 96 picks per inch. The array of warp yarns is joined to the array of weft yarns by stitching yarns of 150 denier type 56 semi-dull filament polyester obtained from DuPont. The stitch length is 1.2 millimeter. This greige fabric weighs 14.0 pounds per ream and has an air permeability of 200 cubic feet per minute per square foot, a warp direction breaking strength of 300 pounds per inch width and a weft breaking strength of 118 pounds per inch width and exhibits an elongation of 7.8 percent when a load of 170 pounds is applied in the warp direction and an elongation of 5.4 percent at 40 pounds per inch load applied in the direction of the weft yarns.

As in Example I, a PVA dipsize based on a 10% by weight solution of Elvanol TM T-66 in water is applied, the fabric dried and thereafter heat set to stabilize the fabric. About 0.75 pounds per ream of PVA dry weight basis is imparted to the fabric (add-on). The air permeability of the fabric after application of the PVA dipsize is about 145 cubic feet per minute. The greige width of the fabric and the PVA dipsized width of the fabric are like those given with respect to Example I.

Following the application of the PVA and drying of the fabric, a backfill is applied to the warp side of the fabric via knife coating. The formulation of the backfill mix is given in Table III.

TABLE III

| Vendor | Ingredient | Weight % Wet | Parts by Weight Dry |
|---|---|---|---|
| E. I. DuPont de Nemours & Co. | Elvanol TM T-66 PVA | 10 | 10 |
| Genstar Stone Products | Calcium Carbonate | 10 | 10 |
| Morton Chemical Div. Morton-Norwich Products | Magnesium Carbonate | 10 | 10 |
| | Water | 70 | 0.00 |

The calcium carbonate employed in this example was obtained from Genstar Stone Products and is known as Camel Carb TM Natural ground limestone. This material has particles of which at least 70% by weight are finer than 15 microns. The magnesium carbonate was obtained from Morton-Norwich Products and has an average particle size of 3 microns. The total solids content of the backfill mix is 30 percent by weight. The backfill mix has a viscosity of 1500–2000 centipoise at the 180°–190° F. application temperature. The dry weight basis add-on of this backfill is from 3 to 4 pounds per ream.

The backfill mix is applied to the warp side of the straight warp fabric to completely block off the fabric without penetrating through the fabric so far as to interfere with and prevent contact of the face fill mix, which is to be subsequently applied, with the weft yarns. The backfilling prevents the subsequently applied backsize mix from penetrating through the warp yarn array and imparts needed body and stiffness to the straight warp fabric as well as protects the warp yarns which will become the principle load bearing component of the coated abrasive composite or belting. The backfilling also protects the warp yarns from penetration by the subsequently applied phenolic facefill mix. Following application of the backfill mix, the fabric is dried as in the first example, with the range or oven set at 250° F. in the first zone and 340° F. in the second zone. The time of exposure of the fabric in each zone is about ¾ minute.

Following application of the backfill mix, there is applied a backsizing mix having the formulation given in Table IV.

TABLE IV

| Vendor | Ingredient | Weight % Wet | Parts by Weight Dry |
|---|---|---|---|
| Rohm & Haas Co. | Rhoplex TM AC-604 Acrylic Latex (46%) | 59.31 | 27.28 |
| National Gypsum Co. | Gold Bond TM Calcium Carbonate Super Fine Pulverized No. 7 Limestone | 28.09 | 28.09 |
| Rohm & Haas Co. | Tamol TM 731 (25%) | 0.31 | 0.08 |
| Harshaw Chemical Co. | W-3247 Burnt Umber Pigment Dispersion (49%) | 1.56 | 0.76 |
| Heveatex Corp. Fall, River, Mass. | Dispersed Black J-1431 (29%) | 0.17 | 0.05 |
| Hercules Powder Co., Inc. | CMC TM Solution* (9%) | ca10.00 | 0.90 |
| McKesson Chemical San Francisco, CA | Ammonium Thiocyanate | 0.56 | 0.56 |

*Sodium Carboxymethylcellulose Gum Grade 7L

The total solids content of the backsize mix is 55–58 percent by weight and has a viscosity at 75° F. of 5000–6000 centipoise. The dry weight basis add-on of the backsize is about 1.38 to 1.92 pounds per ream. The backsizing completes filling up of the warp yarn side of the fabric and protects the warp yarns and stitching yarns and adds body to the fabric.

Following application and drying of the backsizing, the fabric has applied to it a facefilling in the same manner and on the same equipment. The facefilling is applied to the weft side of the cloth. It is to be noted that prior to facefilling, the fabric has been completely blocked off and there are no holes through it even through the weft yarns as yet have no mix on them except the dipsize of PVA. Wetting of the weft yarn bundles and filling the interstices between these yarns is accomplished on the facefilling pass. The formulation of the facefilling mix is given in Table V.

TABLE V

| Vendor | Ingredient | Weight % Wet | Parts by Weight % Dry |
|---|---|---|---|
| HPP Division Carborundum Co. | R6A Phenolic Resin (73%) | 56.55 | 41.28 |
| National Gypsum Co. | Gold Bond TM Calcium Carbonate Super Fine Pulverized No. 7 Limestone filler | 37.67 | 37.67 |
| ICI Americas | Span TM 20 (100%) | 0.28 | 0.28 |
| Various | Furfuryl Aldehyde | ca 5.50 | 0.00 |

The total solids content of the facefilling or warp yarn filling is about 80 percent by weight. The facefilling mix exhibits a viscosity at 90° F. of about 2000 centipoise. On a dry weight basis about 8–10 pounds per ream of facefilling mix is added-on to the cloth. The furfuryl aldehyde is added in that amount necessary to provide a viscosity at 90° F. of about 2000 centipoise. The R6A phenolic resin continues to polymerize slowly with the passage of time in storage, thus increasing in viscosity. This tendency to increase in viscosity is offset by the addition of the furfuryl aldehyde as needed.

Following application of the facefilling mix, the fabric and mix are heated to partially (B-stage) cure the facefilling mix.

The flexible sheet material of this Example II, when finished, typically exhibits a breaking strength of 320 pounds per inch width when measured in the warp direction of the fabric, and an elongation of 5.8 percent when a load of 170 pounds per inch width is applied in the warp direction.

As in Example I, standard technique of applying maker adhesive, grain and size coats are thereafter employed to complete the manufacture of a flexible sheet material according to Example II having abrasive grains adhesively bonded thereto. Typical properties of the finished flexible sheet material of Example II after coating with 24 grit size aluminum oxide, curing of the grit bonding coat and flexing are a breaking strength of 254 pounds per inch width measured in the warp direction of the fabric, an elongation of 5.8 percent at 170 pounds load per inch applied in the warp direction of the fabric, tongue tear value of 10.8 pounds and a peel adhesion value of 23.8 pounds per inch width.

Straight warp fabrics including an array of polyester warp yarns and an array of bulked nylon weft yarns are also suitable as a backing for coated abrasive products including belts. Bulked nylon yarn is available from DuPont as Cordura TM yarn. The bulked nylon weft yarns facilitate filling of the fabric. These straight warp fabrics may be finished as described in Example II. Preferably the abrasive grain is bonded to the weft side of the finished flexible sheet material.

The foregoing description and examples are intended to illustrate the invention without limiting it thereby. It will be understood that various modifications can be made in the invention without departing from the spirit or scope thereof.

What is claimed is:

1. A method of preparing flexible sheet material of the type including a straight warp fabric, including the steps of:

(a) wetting all exposed surfaces of the fabric with an aqueous solution of polyvinyl alcohol;

(b) drying the polyvinyl alcohol wetted fabric under tension to produce a polyvinyl alcohol dipsized fabric;

(c) applying a filling of phenolic formaldehyde resin/latex mixture to the polyvinyl alcohol dipsized fabric;

(d) applying an outer coating of phenol formaldehyde resin including an inorganic pigment dispersed therein.

2. The method of claim 1 further including between steps (b) and (c) heat setting the dipsized fabric.

3. The method of claim 1 wherein a sufficient amount and distribution of polyvinyl alcohol exists to reduce the air permeability of the fabric from about 10 to about 40 percent when compared to the fabric in its greige state.

4. The method of claim 1 wherein the fabric is formed of polyester warp yarns further comprising stretching the dried fabric, maintaining lengthwise tension on the fabric while the fabric is exposed in an oven at about 445° F. (229.5° C.) for a period of about 2.2 minutes and thereafter quenching the heated fabric with forced ambient air while maintaining lengthwise tension on the fabric to prevent further lengthwise shrinkage thereof.

5. The process of claim 1 further comprising prior to step (d) reducing the width of the heat set fabric by removal of a predetermined amount from each longitudinally extending edge.

6. The process of claim 5 further comprising after heat setting and removal of a predetermined amount from each longitudinally extending edge of the fabric, dipping the fabric in a phenolic resin/latex mixture having a resin to latex dry weight basis ratio of about 1:1.

7. The process of claim 6 wherein the fabric is twice dipped in a phenolic resin/latex mixture to achieve a total dry weight basis add on of about 7.8 to 12.4 percent of phenolic resin/latex mixture by weight based on the heat treated fabric weight.

8. A method of preparing a flexible sheet material of the type including a straight warp fabric having a planar array of warp yarns juxtaposed to a planar array of weft yarns, including the steps of:

(a) wetting all exposed surfaces of the fabric with an aqueous solution of polyvinyl alcohol, (b) drying the polyvinyl alcohol wetted fabric under tension to produce a PVA dipsized fabric, (c) heat setting the dipsized fabric, (d) forming a backfilling including approximately equal parts of calcium carbonate, magnesium carbonate and poly vinyl alcohol dispersed in water (e) filling one of said arrays of yarns while leaving the other array unfilled with said backfilling material and setting the filling, (f) applying a backsize over that array of yarns of the fabric that has been filled, (g) filling the unbackfilled array of the fabric with a phenolic resin/calcium carbonate filler mixture having a resin to filler ratio of about 1.1:1 on a dry weight basis.

9. The method of claim 8 wherein the fabric is formed of polyester warp yarns further comprising stretching the dried fabric, maintaining lengthwise tension on the fabric while the fabric is exposed in an oven at about 445° F. (229.5° C.) for a period of about 2.2 minutes and thereafter quenching the fabric with forced ambient air while maintaining sufficient lengthwise tension on the fabric to prevent further lengthwise shrinkage thereof.

10. The method of claim 8 wherein subsequent to heat setting of the encapsulated fabric the width of the fabric is reduced by removal of a predetermined amount from each longitudinally extending edge.

11. The method of claim 1 further comprising bonding abrasive grains to said sheet material.

12. The method of claim 11 further comprising forming the sheet material into an endless belt.

13. The process of claim 4 further comprising prior to step (d) reducing the width of the heat set fabric by removal of a predetermined amount from each longitudinally extending edge.

14. The method of claim 8 further comprising bonding abrasive grains to said sheet material.

* * * * *